US010434376B2

(12) United States Patent
Larson

(10) Patent No.: US 10,434,376 B2
(45) Date of Patent: Oct. 8, 2019

(54) ILLUMINATED BALL

(71) Applicant: Jeffrey Scott Larson, Idaho Falls, ID (US)

(72) Inventor: Jeffrey Scott Larson, Idaho Falls, ID (US)

( * ) Notice: Subject to any disclaimer, the term of this patent is extended or adjusted under 35 U.S.C. 154(b) by 278 days.

(21) Appl. No.: 15/388,331

(22) Filed: Dec. 22, 2016

(65) Prior Publication Data

US 2017/0100645 A1 Apr. 13, 2017

Related U.S. Application Data

(63) Continuation-in-part of application No. 15/049,969, filed on Feb. 22, 2016, now Pat. No. 9,533,197.

(60) Provisional application No. 62/119,183, filed on Feb. 22, 2015.

(51) Int. Cl.

| | |
|---|---|
| ***A63H 27/10*** | (2006.01) |
| ***A63B 43/06*** | (2006.01) |
| ***A63B 41/12*** | (2006.01) |
| ***B67D 7/02*** | (2010.01) |
| ***B67D 7/42*** | (2010.01) |
| ***A63B 41/00*** | (2006.01) |
| ***A63B 39/00*** | (2006.01) |
| ***A63B 39/02*** | (2006.01) |
| ***A63B 39/04*** | (2006.01) |
| ***A63B 43/00*** | (2006.01) |
| *A63B 41/08* | (2006.01) |

(52) U.S. Cl.

CPC ..... *A63B 43/06* (2013.01); *A63B 39/00* (2013.01); *A63B 39/027* (2013.01); *A63B 39/04* (2013.01); *A63B 41/00* (2013.01); *A63B 41/12* (2013.01); *A63B 43/004* (2013.01); *A63H 27/10* (2013.01); *B67D 7/0288* (2013.01); *B67D 7/42* (2013.01); *A63B 41/085* (2013.01); *A63B 2207/02* (2013.01); *A63B 2220/75* (2013.01); *A63B 2220/801* (2013.01); *A63B 2220/833* (2013.01); *A63B 2225/605* (2013.01); *A63H 2027/1033* (2013.01); *A63H 2027/1058* (2013.01); *A63H 2027/1083* (2013.01)

(58) Field of Classification Search

CPC ..... A63H 2027/1033; B67D 7/42
USPC ..... 141/329
See application file for complete search history.

(56) References Cited

U.S. PATENT DOCUMENTS

| | | | | |
|---|---|---|---|---|
| 2,721,342 | A | 10/1955 | Pickren | |
| 3,229,976 | A | 1/1966 | Allen, Jr. | |
| 3,902,517 | A * | 9/1975 | Hastwell | F04F 1/06 137/209 |
| 4,314,423 | A | 2/1982 | Lipsitz | |

(Continued)

*Primary Examiner* — Timothy L Maust
(74) *Attorney, Agent, or Firm* — Schmeiser, Olsen & Watts LLP

(57) ABSTRACT

A filling device may be used to fill a ball or other inflatable item from a water source such as a hose. A filling device may include an adapter having a cylindrical body with a hollow threaded interior, one closed end and one open end. A filling coupler is coupled to the one closed end of the cylindrical body. The one closed end of the cylindrical body has an opening formed therethrough and the filling coupler is coupled to the one closed end covering the opening. The filling coupler has a hollow threaded interior in fluid communication with the opening. A tip may be removably coupled to the filling coupler. The tip may be a ball inflation needle, a water balloon filling tip or the like.

5 Claims, 19 Drawing Sheets

(56) References Cited

U.S. PATENT DOCUMENTS 4,595,200 A 6/1986 Shishido
4,916,846 A 4/1990 Pehm
5,007,448 A * 4/1991 Olinger ..... B60C 29/062 137/223
5,102,131 A 4/1992 Remington
5,499,822 A 3/1996 Sabourin
5,609,411 A 3/1997 Wang
5,639,076 A 6/1997 Cmiel
5,697,182 A 12/1997 Rodgers
5,746,243 A * 5/1998 Franke ..... F16K 15/145 137/223
5,888,156 A 3/1999 Cmiel et al.
5,903,212 A 5/1999 Rodgers
5,989,091 A 11/1999 Rodgers
6,416,430 B2 7/2002 Moore
6,485,158 B1 11/2002 Bisotto
6,502,953 B2 1/2003 Hajanpour
6,786,247 B1 * 9/2004 Kemppainen ..... F04B 33/005 137/223
7,049,766 B2 5/2006 Lewis
7,261,432 B1 8/2007 Habitz
7,963,297 B2 * 6/2011 Huang ..... F04B 33/005 137/223
8,337,040 B1 12/2012 Easley
9,533,197 B2 1/2017 Larson
9,557,135 B2 * 1/2017 Liang ..... F41B 9/004
2003/0178092 A1 * 9/2003 Birmingham ..... A63B 41/12 141/38
2003/0224885 A1 12/2003 Leal
2004/0055663 A1 * 3/2004 Gaines ..... A63B 41/12 141/67
2005/0133637 A1 * 6/2005 Chen ..... B05B 1/005 239/569
2006/0196104 A1 9/2006 Lapointe
2007/0021244 A1 1/2007 Ko
2007/0037470 A1 2/2007 Rothan
2007/0223220 A1 9/2007 Flagle
2008/0121309 A1 * 5/2008 Boise ..... A63H 27/10 141/313
2009/0268427 A1 10/2009 Ashby
2011/0030847 A1 * 2/2011 Wang ..... A63H 27/10 141/375
2011/0223826 A1 9/2011 Gibson
2011/0287688 A1 11/2011 Hang
2012/0040785 A1 2/2012 De Sort
2012/0067453 A1 * 3/2012 Ramere ..... A63H 27/10 141/1
2012/0097293 A1 * 4/2012 Dancescu ..... A63H 27/10 141/317
2012/0267004 A1 * 10/2012 Sikorcin ..... A63H 27/10 141/314
2013/0335949 A1 12/2013 Kao
2014/0094085 A1 4/2014 Loetz
2014/0216570 A1 * 8/2014 Connors ..... F16K 15/207 137/230
2015/0111461 A1 4/2015 Lu
2015/0129084 A1 5/2015 Maw et al.
2015/0174459 A1 6/2015 Won
2016/0256792 A1 9/2016 Mowbray

* cited by examiner

ILLUMINATED BALL

CROSS REFERENCE TO RELATED APPLICATION[S]

This application claims priority to U.S. Provisional Patent Application entitled "LUMINOUS UNDERWATER PLAY BALL," Ser. No. 62/119,183, filed Feb. 22, 2015, and to U.S. patent application entitled "ILLUMINATED BALL," Ser. No. 15/049,969, filed Feb. 22, 2016, the disclosures of which are hereby incorporated entirely herein by reference.

BACKGROUND OF THE INVENTION

1. Technical Field

This invention relates to illuminated play balls and filling devices which allow items such as play balls to be filled with water in order to alter the item's bouyancy.

2. Background Art

Illuminated play balls may be used in many different situations, such as playing games in the dark, playing games underwater, and the like.

Currently, however, illuminated play balls have many problems. For example, many illuminated play balls require that a manual switch be turned on in order to illuminate the ball. The switch must then be turned off after the user is done playing with the ball. If the user forgets to turn the switch off, the ball will remain lit and the batteries or other power source in the ball will be used up and die.

Additionally, many illuminated play balls may not be water tight. Therefore, if the ball is used in the water, the illumination device may get wet and malfunction.

Further there is a need for an illuminated play ball with adjustable buoyancy. There are games which can be played in a pool, lake or the like, which require the ball to have positive buoyancy, neutral buoyancy or negative buoyancy depending on the game. Therefore, being able to adjust the buoyancy would allow the user to be able to use the illuminated play ball for many more game types.

While several references disclose illuminated play balls, none of these devices have solved all of the problems discussed above.

Allen, Jr., U.S. Pat. No. 3,229,976, is relevant in its disclosure of an inflatable beach ball with a tube which passes through the center of the ball. The tube contains batteries and a light source.

Wang, U.S. Pat. No. 5,609,411, is relevant in its disclosure of a light up inflatable ball. The illuminating device includes at least one light source and a battery. The lights may be motion activated or may have a manual switch.

Cmiel et al., U.S. Pat. No. 5,888,156, is relevant in its disclosure of a light up inflatable ball with an outer and inner shell. A light source and battery are located between the shells. The light is turned on by vibration and may be used in water.

Additionally, balls or other inflatable items used in a pool or the like, may require that their buoyancy be altered in order to cause the item to have neutral or negative buoyancy. One of the easiest ways to adjust the buoyancy of an inflatable item is to fill the item with something other than air, such as water or the like. However, often a ball will have an inflation opening that requires an inflation needle. These needles, while usable with an air pump, are not designed to allow water from a hose or faucet to be used to inflate the ball.

While, U.S. Pat. No. 5,499,822, issued to Sabourin (hereinafter "Sabourin") discloses an inflation needle that hooks to a hose or a faucet, Sabourin does not disclose an adapter which allows a normal inflation needle to be coupled to a hose. If the Sabourin inflation needle is broken, the entire filling device must be replaced, instead of just the needle. Additionally, Sabourin does not allow different types of tips to be coupled to the same adapter.

Accordingly, what is needed is an illuminated ball that can be used in water and that automatically turns itself off after use in water. Additionally, an illuminated ball with adjustable buoyancy is needed. Further, an adapter which is removably couplable to an inflation needle or other type of tip and which allows the needles or tips to be used to fill an item with water is also desired.

DISCLOSURE OF THE INVENTION

The illuminated ball, as disclosed hereafter in this application, is a ball which may be filled with air and/or water and which contains a lighting device which is triggered by immersing the ball in water. Additionally, a filling device is disclosed for filling the illuminated ball with water.

In particular embodiments, an illuminated ball may include a hollow, spherical shell. A translucent light housing may be coupled to the shell. A light emitting device may be within the translucent housing. The light emitting device having a first circuit board, a light emitting element coupled to the first circuit board and a battery housing coupled to the light emitting device. At least one battery may be within the battery housing. A second circuit board may be coupled to the battery housing. At least four conductors may be coupled to the second circuit board, wherein two of the at least four conductors are coupled to the light emitting device and another two of the at least four conductors are coupled to at least two water contacts. The at least two water contacts are located on an outside of the illuminated ball, wherein on exposure to water, the at least two water contacts are electrically connected causing the light emitting element to be illuminated.

Additional embodiments of an illuminated ball for use in a water environment may include an outer shell, a translucent housing forming an air tight coupling with the outer shell, and a self closing valve coupled to the outer shell. A battery housing forming a water tight coupling with the translucent housing. At least one battery may be in the battery housing. A light emitting device may be electrically coupled to the battery housing. A water triggered switch may also be electrically coupled to the battery housing, wherein on exposure to water, the water triggered switch, the light emitting device and the at least one battery form an electrical circuit.

Other embodiments of an illuminated ball may have a shell, and a neck, where the neck forms an opening into the interior of the shell. A housing coupled to the neck. An adhesion contour is coupled to the housing and abuts an indentation in the neck. The housing, the neck and the shell form an air tight chamber. A light emitting device may be coupled inside the housing. The light emitting device includes a first circuit board and a light emitting diode. A battery housing may be coupled to the light emitting device. A power source may be coupled to the battery housing. A water triggered switch may also be coupled to the battery housing. The water triggered switch having a second circuit board and at least two water contacts. The at least two water contacts, the power source and the light emitting diode forming a circuit on exposure of the at least two water contacts to water.

Embodiments of a filling device include an adapter, with a cylindrical body having a hollow threaded interior, one closed end and one open end. A filling coupler is coupled to the one closed end of the cylindrical body, the one closed end of the cylindrical body having an opening formed therethrough. The filling coupler is coupled to the one closed end covering the opening. The filling coupler has a hollow threaded interior in fluid communication with the opening. A tip is removably coupled to the filling coupler.

An additional embodiment of a filling adapter includes a first hollow cylindrical body having an open end and a partially open end; threads formed in the interior of the first hollow cylindrical body; and a second hollow cylindrical body coupled to an opening in the partially open end of the first hollow cylindrical body. A coupler coupled to the second hollow cylindrical body, wherein the coupler is configured to removably couple filling tips to the filling adapter.

Alternate embodiments of a filling device include an adapter, wherein said adapter includes a first hollow cylindrical body having a first open end and a second open end with a threaded interior. A coupler surrounds the second open end. The coupler includes a second hollow cylindrical body. The coupler has a threaded hollow interior. A filling attachment is removably coupled to the coupler. The filling attachment has an opening at a first end and a second end.

The foregoing and other features and advantages of the illuminated ball and filling device will be apparent to those of ordinary skill in the art from the following more particular description of the invention and the accompanying drawings.

BRIEF DESCRIPTION OF THE DRAWINGS

The invention will hereinafter be described in conjunction with the appended drawings where like designations denote like elements, and.

DESCRIPTION OF THE INVENTION

Figure 1:
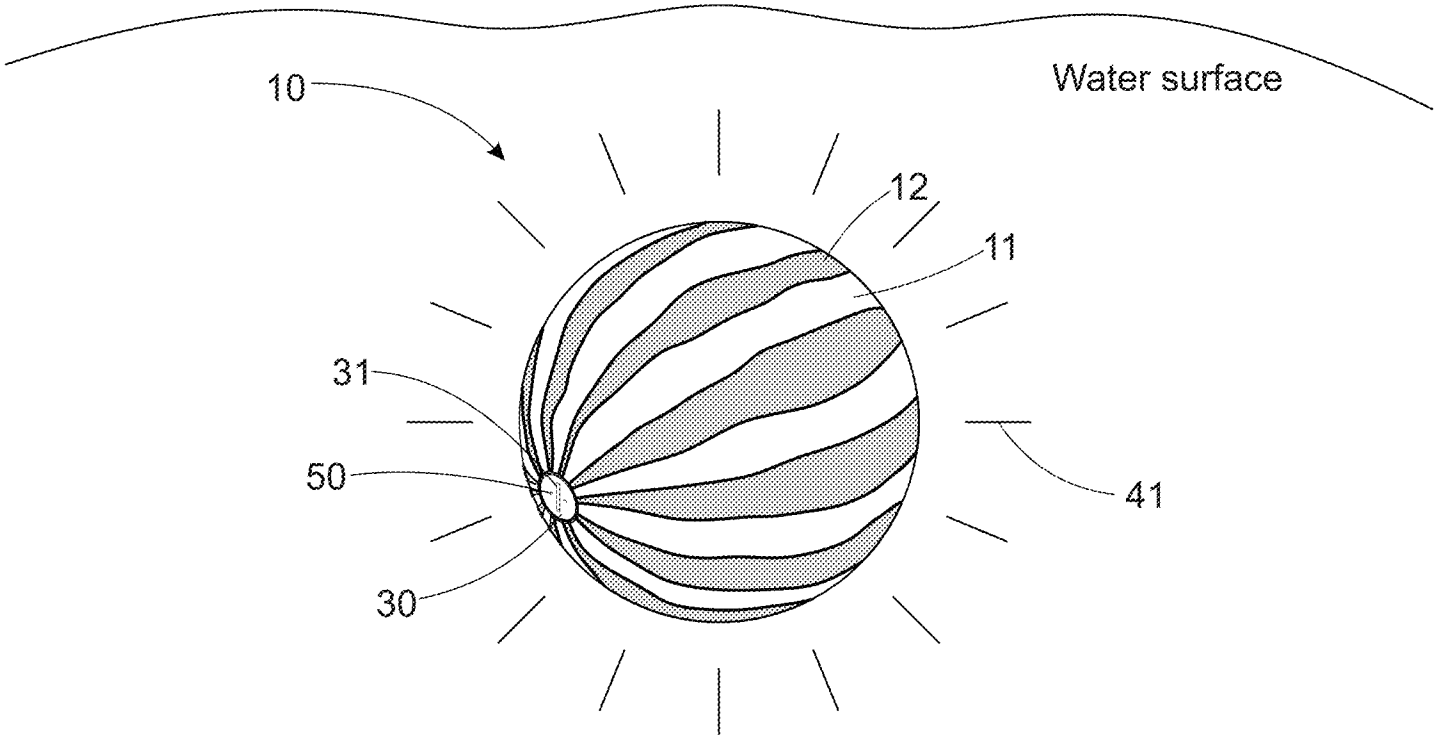
FIG. 1 is an isometric view of an illuminated ball in water.
Figure 2:
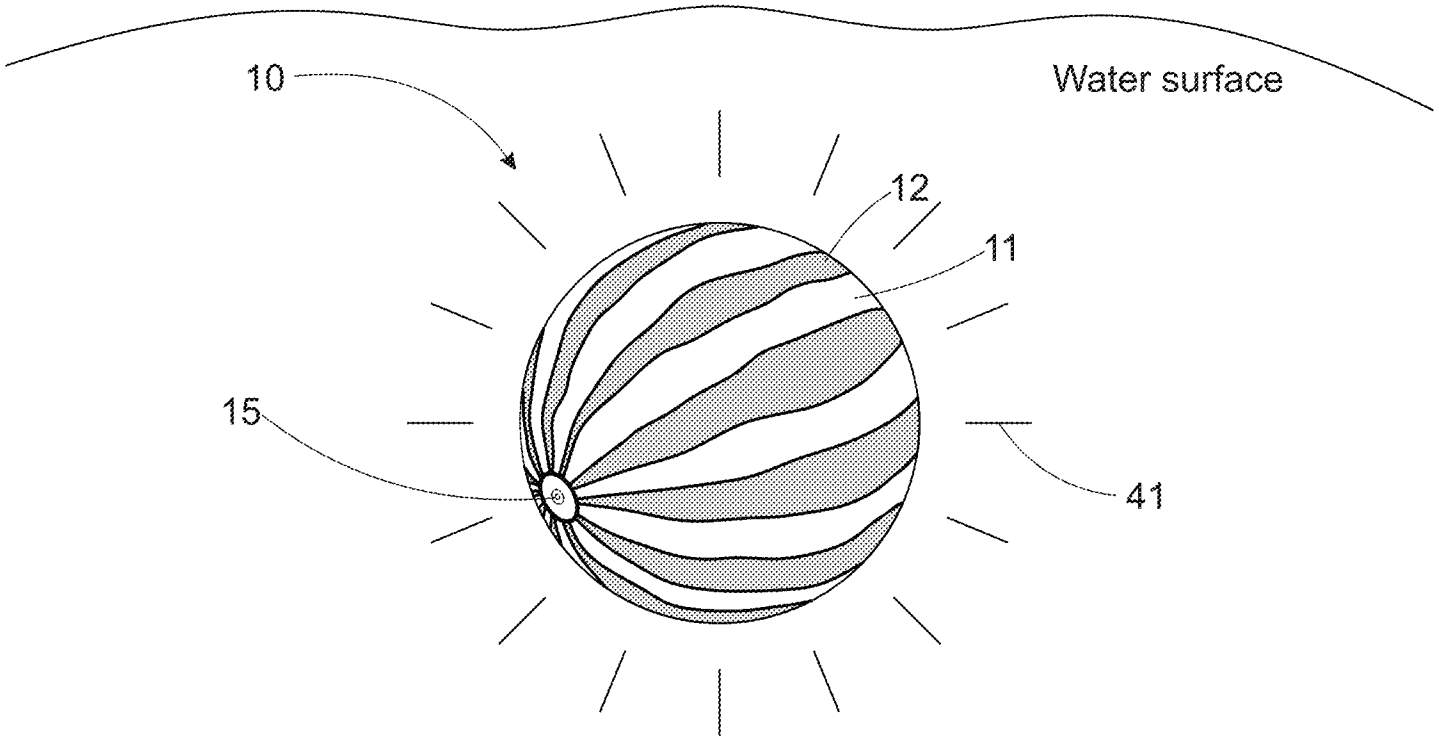
FIG. 2 is a back view of an illuminated ball.

As discussed above, embodiments of the present invention relate to an illuminated play ball for use in a water environment such as a pool, a lake, a river or the like. In particular, disclosed is an illuminated ball that can be made to have positive, neutral or negative buoyancy and which automatically turns on when the ball is in the water and off when the ball is out of the water. Additionally, a filling device is disclosed which allows a play ball or other inflatable item to be filled with water.

FIGS. 1-4 illustrate an underwater play ball 10 having a shell 11 with a hollow cavity or interior 9, a light housing 20 extending into the hollow cavity 9 and bonded to the shell 11, a threaded battery housing 30 screwed into the light housing 20, a light emitting device 40 as part of the battery housing 30, and a water triggered switch 50 as part of the battery housing 30 to activate the light emitting device 40.

An illuminated underwater play ball 10 having a spherical structure comprised of a hollow cavity 9 and shell 11. The underwater play ball 10 preferably contains a self closing valve 15 or other device which allows water and air to enter the hollow cavity 9 through the shell 11. The self closing valve 15 is similar to those already used on various balls. The self closing valve 15 is formed from rubber or a similarly compliant material. The self closing valve 15 is typically cylindrical in shape with a small opening through the center axis of the cylinder. The self closing valve 15 allows a needle, such as used on a filling device 16 like a ball pump, to be inserted in the small opening through the center axis of the self closing valve 15. The needle forces the opening to expand. Once the needle is removed from the valve, the small opening retracts, preventing air or water from escaping the ball 10.

The shell 11 may have a graphic 12 printed on its external surface. The function of the underwater play ball 10 is for holding both water and air pressure without rupturing the shell 11. A water proof translucent or transparent light housing 20 extends into the hollow cavity 9 and is bonded to the shell 11.

The underwater play ball 10 is comprised of a hollow cavity 9 and shell 11 with a spherical structure as illustrated in the figures. The cavity 9 size can vary, but the preferred cavity 9 size may equal the size of an average soccer ball. The shell 11 is made of a strong flexible translucent PVC material capable of holding both water and air without rupturing. The exterior surface of the shell 11 may exhibit a graphic 12 but the graphic 12 provides no structural or functional benefits to the underwater play ball 10. The shell 11 contains a self closing valve 15 by which a filling device 16 may be utilized to inject water 13 or air 14 into the hollow cavity 9 of the ball 10. The amount of the water 13 and air 14 can be adjusted to give the ball 10 positive buoyancy 17, neutral buoyancy 18, or negative buoyancy 19, when placed in a swimming pool or other body of water.

While illustrated as a sphere, the shell 11 may be any shape desired. The shell 11 may be formed as an oval, a football, a ring, a character, an animal or the like.

The shell 11 may be a single solid color or it may have a graphic 12 printed on it. The shell 11 may be printed to look like a watermelon, soccer ball, basketball, baseball, volleyball, cartoon character, animal or the like. The shell 11 may be completely transparent or translucent. A completely transparent or translucent shell 11 may still be colored or have a graphic 12, however, the colors and the graphic 12 would also be translucent. Alternatively, the shell 11 may only have portions that are transparent or translucent and portions that are opaque. A graphic 12, printed on a shell with only transparent portions, may have an opaque design with transparent areas in the design, such as behind a character, a character's eyes, or the like.

The shell 11 may also be smooth or textured. The shell 11 may be formed from a smooth surface with no texture on the surface. The shell 11 may also be formed with a texture such as a playground ball might have. The texture would allow the ball 10 to be easier to catch and hold onto in situations where the ball 10 or the user is wet.

The material of the shell 11 of the underwater play ball 10 is not limited to PVC, but may be any strong flexible translucent material that can withstand pressure created by water and air contained within the hollow cavity 9 of the ball 10.

The shell 11 may have a neck 24 formed in its surface. The neck 24 extends into the hollow cavity 9 of the ball 10. The neck 24 is illustrated as a cylindrical indentation formed in the shell 11 of the ball 10. The end of the neck 24 adjacent the cavity 9 of the ball 10 has an opening formed in it.

The interior wall of the neck 24 has an adhesion contour receiving indentation 25 formed in it. The adhesion contour receiving indentation 25 is an indentation that is formed along the circumference of the neck 24. The adhesion contour receiving indentation 25 receives an adhesion contour 23 formed in the surface of the light housing 20. The adhesion contour receiving indentation 25 and the adhesion contour 23 help to prevent the light housing 20 from sliding in the neck 24.

FIGS. 3-7 illustrate an illuminating portion 26 of the illuminated ball 10, which is the mechanism that causes the ball 10 to emit light. The illuminated portion 26 of the illuminated ball 10 includes a light housing 20, a battery housing 30, a light emitting device 40 and a water triggered switch 50.

A light housing 20 which is placed in the neck 24 of the shell 11 of the ball 10. The light housing 20 is comprised of a hollow cavity 9 with a cylindrical shape and opening at one end as illustrated in the figures. The light housing 20 may have a hollow cylindrical translucent or transparent structure, however various other non-cylindrical structures may be utilized for the light housing 20. The housing 20 may be formed in any size or shaped desired. While illustrated as a cylinder, the housing 20 could be square, rectangular, spherical or the like.

The light housing 20 may be made of a strong translucent plastic material capable of passing light through its structure. The housing 20 may be formed of any type of material that allows light to pass through it, thereby making the housing 20 transparent or translucent. Additionally, the housing 20 should be formed from a material which is strong and hard enough to withstand the forces caused by the ball bouncing up and down.

The housing 20 is open at one end and contains screw threads 22 on the interior surface near the opening for reversible mechanical fastening; however various other means of reversible mechanical fastening may be utilized. The function of the light housing 20 is to provide a water tight hollow cavity 9 that is bonded to the shell 11 of the ball 10. The light housing 20 provides a cavity 9 whereby a battery housing 30 can be fastened into and contained within.

The light housing 20 includes an adhesion contour 23 to promote adhesion of the light housing 20 to the shell 11 of the underwater play ball 10. The adhesion contour 23 is a ridge formed along the circumference of the light housing 20. The adhesion contour 23 fits in the adhesion contour receiving indentation 25 formed in the neck 24. The mating of the adhesion contour 23 and the adhesion contour receiving indentation 25 helps to prevent the light housing 20 from sliding vertically in the neck 24.

The light housing 20 contains a sealing element shelf 21 or flat surface for a sealing element to seat to.

The light housing 20 may contain multiple contours to increase the adhesion of the light housing 20 to the shell 11 of the underwater play ball 10.

A battery housing 30 is inserted into the light housing 20. The battery housing 30 has a cylindrical shape that has two ends, one being solid and the other being hollow as illustrated in FIGS. 3-7. The solid end of the battery housing 30 contains screw threads 36 for reversible mechanical fastening and a sealing element shelf 39 or flat surface for the sealing element 38 to seat to.

The screw threads 36 on the battery housing 30 may be substituted with a different type of mechanical fastening system that provides a reversible connection. The screw threads 36 allow the battery housing 30 to be securely coupled to the light housing 20 by rotating the battery housing 30 and mating the screw threads 36 on the battery housing 30 with the screw threads 22 on the light housing 20.

The solid end of the battery housing 30 also contains a slot 31 sized large enough for a coin, screw driver, or rigid flat object to be inserted into the slot 31. When an object is inserted into the slot 31, the object may then be used to rotate the battery housing 30 within the light housing 20, which causes the battery housing 30 to be unscrewed from the light housing 20 so that it may be removed.

The slot 31 may be replaced with a Philips screw head, an allen wrench receiver or the like. The slot 31 may be anything that allows the battery housing 30 to be rotated within the light housing 20.

The hollow end of the battery housing 30 contains a sealing element groove 33 located adjacent and below the screw threads 36 of which a sealing element 32 can sit within the groove 33. A single sealing element may be utilized to create a water tight seal or three or more sealing elements may be utilized to create a water tight seal. The sealing element 32 may be a washer or the like. The sealing element groove 33 is a groove configured to receive a sealing element 32 such as a washer or the like.

An additional sealing element 38 is located at the solid end of the battery housing 30. The additional sealing element 38 is located above the screw threads 36. The additional sealing element 38 may be a washer or the like. The additional sealing element 38 is placed on a sealing element shelf 39 formed in the battery housing 30 itself.

The hollow end of the battery housing 30 contains a battery opening 34 to allow batteries 35 or another power source to be inserted into the hollow cavity in the battery housing 30. The battery housing 30 as illustrated is a hollow cylindrical member. The battery opening 34 is a cut in the wall of the battery housing 30, which allows a power source to be placed within the battery housing.

The batteries 35 or power source may be any type of battery that provides sufficient power to the illuminated ball 10. The batteries 35, as illustrated, may be at least one button battery. In the alternative, AA, AAA, C, D or the like size batteries may be used to operate the illuminated ball 10.

A battery contact is located inside the battery housing 30 at both the top and the bottom of the batteries 35. This allows electricity to flow from the batteries 35 to the illuminated ball 10.

The hollow end contains two conductor guides 37 or channels on the interior surface of the battery housing 30. The two conductor guides 37 may be used to contain conductors which form part of the electrical circuit that causes the illuminated ball 10 to illuminate.

A light emitting device 40 is coupled to the hollow end of the battery housing 30 and is placed inside the light housing 20. The light emitting device 40 includes a circuit board 45 comprised of connected components which include a light emitting diode 42, multiple resistors 46 and 48, capacitor 47, mosfet 49 having internal gate electrostatic discharge protection, manual switch 44, and battery contact 43 as illustrated on FIGS. 4-8. A schematic representation showing the manner in which the components are connected by the circuit board 45 to create a circuit that produces an emitted light 41 via light emitting diode 42 is illustrated in FIG. 8.

The resistors 46 and 48, capacitor 47, and mosfet 49 may be substituted with other components such as integrated circuits that provide the same function.

The light emitting diode 42 is the light or light producing device for the illuminated ball 10. Once the light emitting diode 42 is turned on, the illuminated ball 10 emits light as illustrated in FIG. 1, showing emitted light 41.

The capacitor 47 acts to store electric charge for the circuit. If electricity is cutoff from the light emitting diode 42, the capacitor 47 continues to provide electric charge on a short term basis to the light emitting diode 42.

A battery contact 43 is also coupled to the circuit board 45. The battery contact 43 electrically connects the power source or batteries 35 to the light emitting device 40.

A water triggered switch 50 having a circuit board 53 with a second battery contact 54 connected to the circuit board 53 and four conductors 51, 52, 57 and 58 extending from the circuit board 53. The water triggered switch 50 and circuit board 53 are located at the solid end of the battery housing 30. The water triggered switch 50 is located towards the outer surface of the shell 11 of the ball 10.

Figure 6:
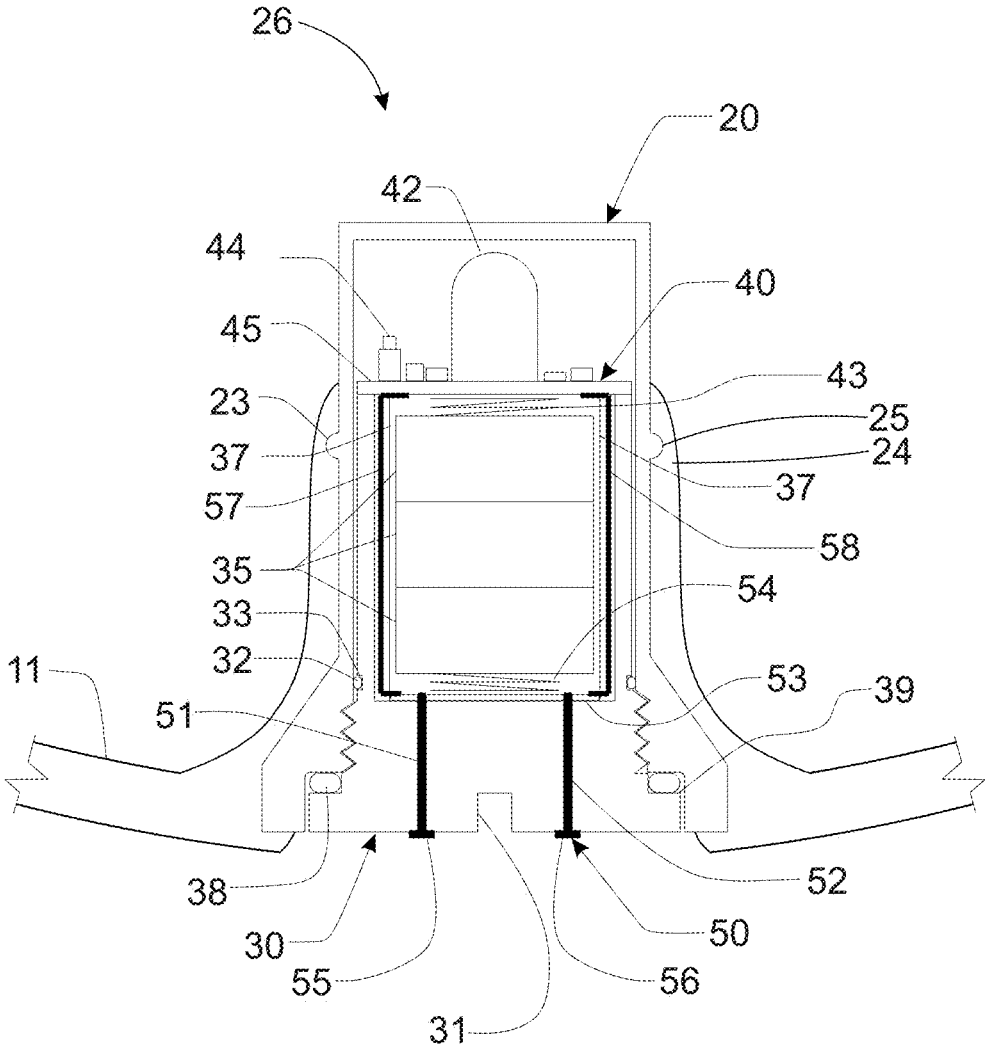
FIG. 6 is a section view of the illuminating portion of an illuminated ball taken along the center axis of the illuminating portion.
Figure 7:
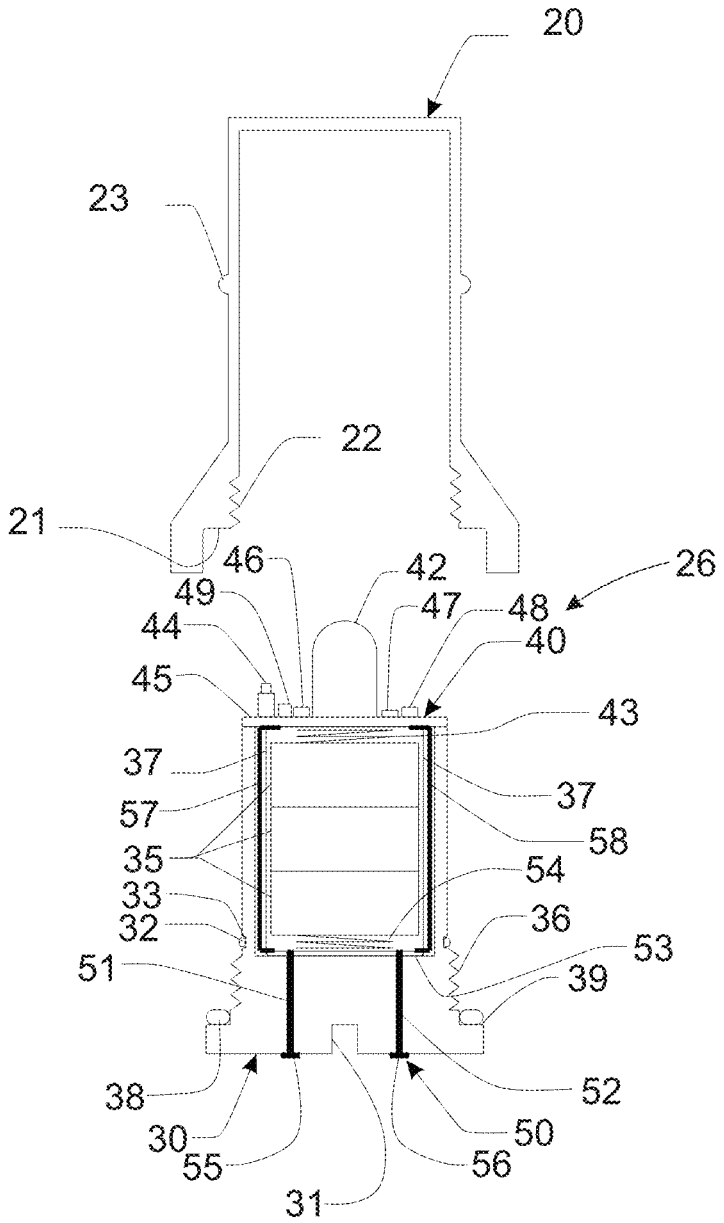
FIG. 7 is an exploded section view of the illuminating portion of an illuminated ball taken along the center axis of the illuminating portion.
Figure 8:
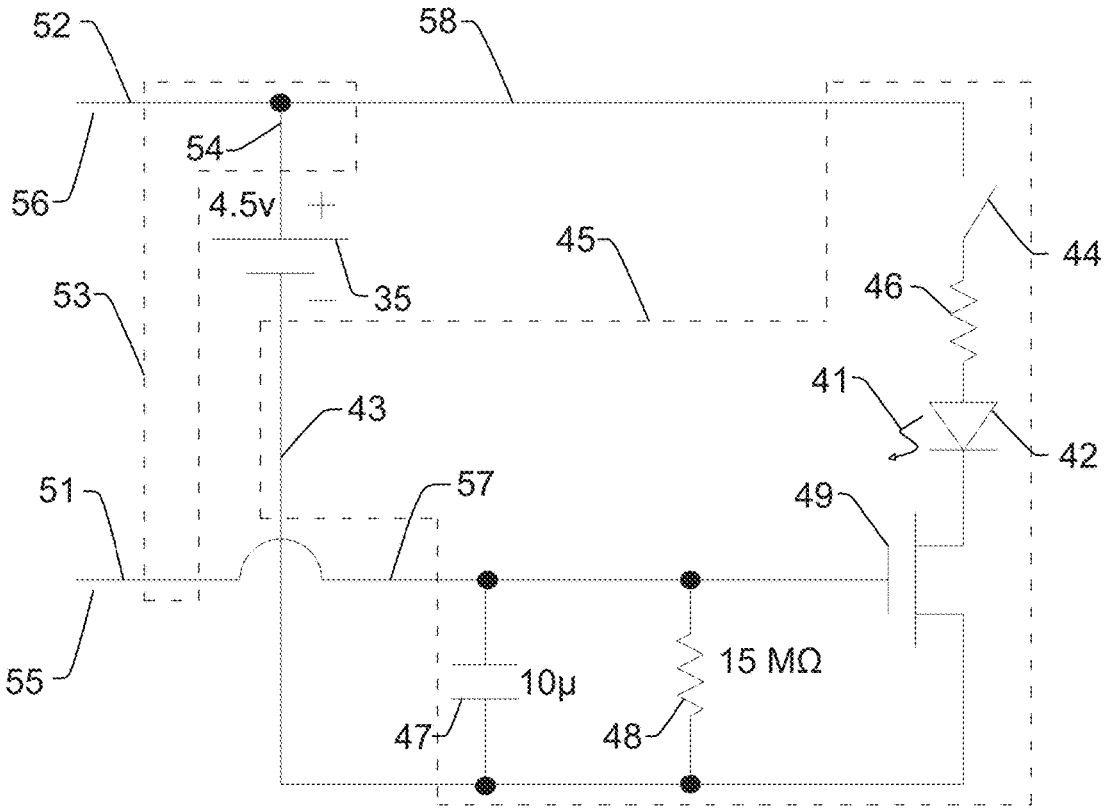
FIG. 8 is an electrical diagram of the illuminating portion of an illuminated ball.

The water triggered switch 50 includes a circuit board 53 comprised of connected components which include a battery contact 54 and conductors 51, 52, 57 and 58 as illustrated in FIGS. 6-8. Conductors 51 and 52 are connected to water contacts 55 and 56 respectively. A schematic representation showing the manner in which the components are connected to the circuit board 53 is illustrated in FIG. 8.

The battery contact 54 contacts the end of the batteries 35 or power source opposite of battery contact 43.

Conductors 51, 52, 57 and 58 are all electrically conductive wires that allow electricity to move through the illuminating portion 26 of the ball 10 in order to light the ball 10.

Conductors 51 and 52 are coupled to water contacts 55 and 56 which are metal contacts that extend to the outside of the shell 11 of the ball 10 in order to contact water once the ball 10 is exposed to or submerged in water.

Conductors 57 and 58 are located in conductor guides 37 which prevent conductors 57 and 58 from coming in to contact with batteries 35, while allowing the conductors 57 and 58 to connect to the light emitting device 40 at the opposite end of the battery housing 30.

Figure 4:
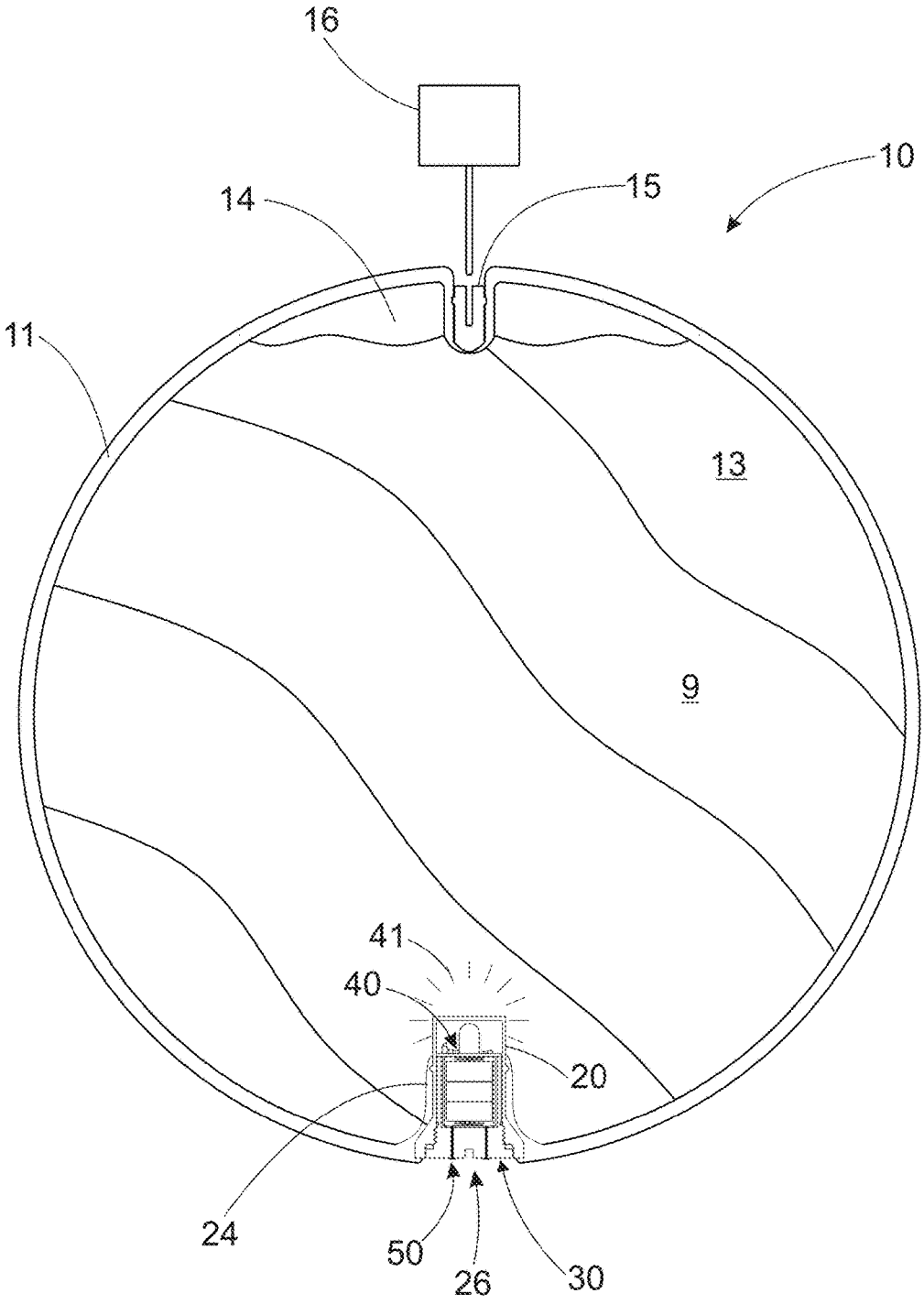
FIG. 4 is a section view of an illuminated ball taken along the center axis of the illuminating portion of the illuminated ball.

In an embodiment of an illuminated ball 10, the light housing 20 is bonded to the shell 11 of the underwater play ball 10 as illustrated in FIGS. 4 and 6. The light housing 20 may be bonded to the shell 11 via various conventional attachment methods commonly utilized to manufacture play balls.

Figure 5:
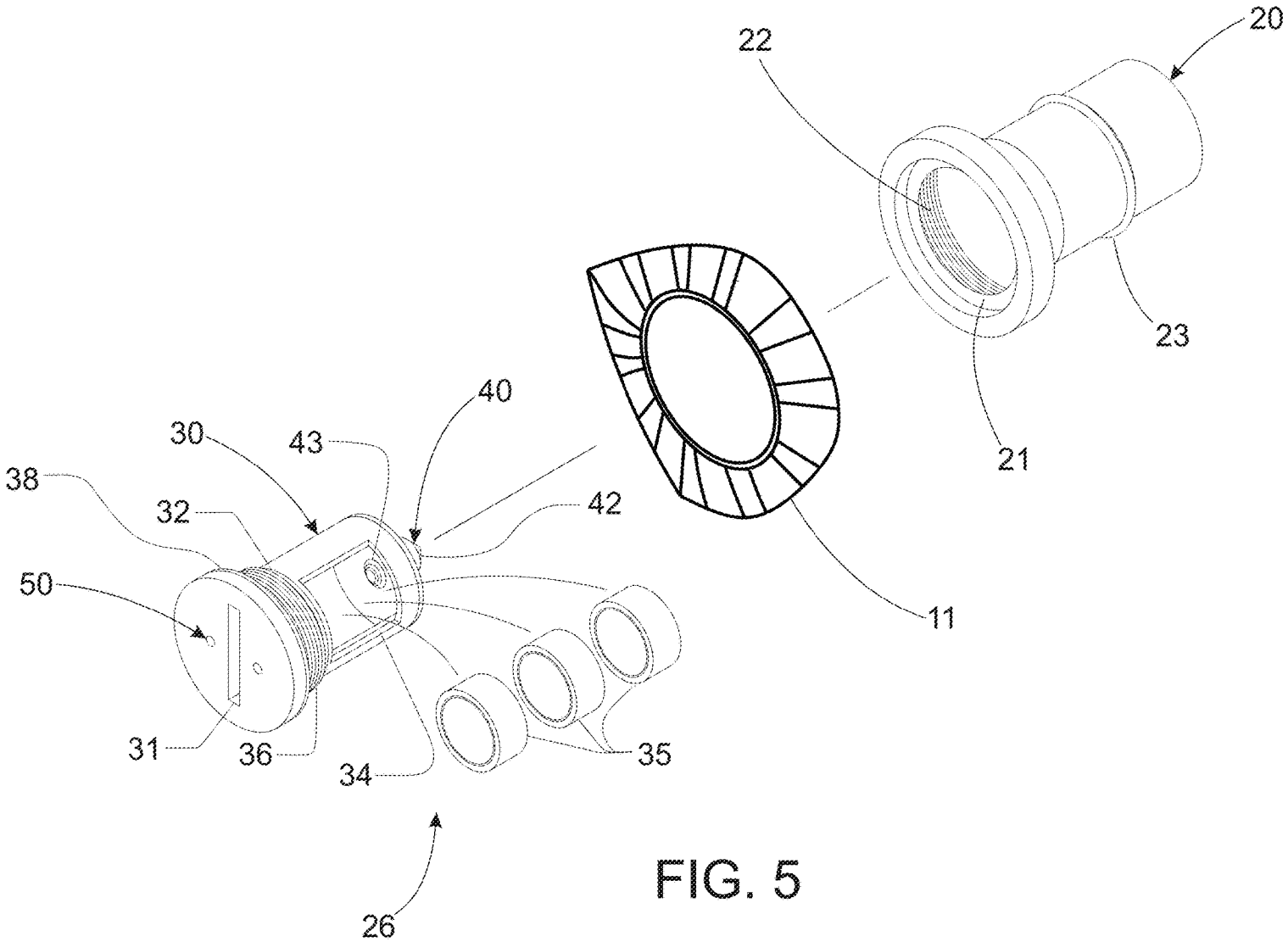
FIG. 5 is an exploded view of an illuminating portion of an illuminated ball.

The water triggered switch 50 connects to the battery housing 30 as illustrated in FIGS. 5-7. The water contacts 55 and 56 are connected to the conductors 51 and 52 respectively, and may be one continuous part. The conductors 51 and 52 are preferably molded into the battery housing 30 or may be inserted by other conventional means which provides a water tight seal between the battery housing 30 and conductors 51 and 52. The battery contact 54 and conductors 51, 52, 57 and 58 are attached to the circuit board 53 via conventional attachment methods commonly utilized for circuitry. The conductors 57 and 58 sit within the conductor guides 37 to prevent contact between the conductors 57 and 58 and the batteries 35.

The light emitting device 40 is attached to the battery housing 30. The light emitting diode 42, battery contact 43, manual switch 44, resistors 46 and 48, capacitor 47, and mosfet 49 are attached to the circuit board 45 as illustrated in FIGS. 4-8. The circuit board 45 is attached to the conductors 57 and 58. The components attached to the circuit board 45 are attached via conventional attachment methods commonly utilized for circuitry.

The batteries 35 insert into the battery housing 30 through the battery opening 34. The battery housing 30 inserts into the light housing 20 and fastens to the light housing 20 via screw threads as illustrated in FIGS. 4-7. The battery housing 30 may be fastened to the light housing 20 via various other conventional reversible mechanical fastening methods.

The light emitting diode 42 within the light emitting device 40 is in electrical communication with the batteries 35 which provide electrical power to the light emitting diode 42. The manual switch 44 and water triggered switch 50 are connected between the light emitting diode 42 and batteries 35 via the mosfet 49 and resistor 46 to allow electrical current to be conducted to the light emitting diode 42 as illustrated in FIG. 8. The resistor 48 and capacitor 47 within the light emitting device 40 allow further control of electrical current conducted to the light emitting diode 42 as illustrated in FIG. 8.

Figure 10:
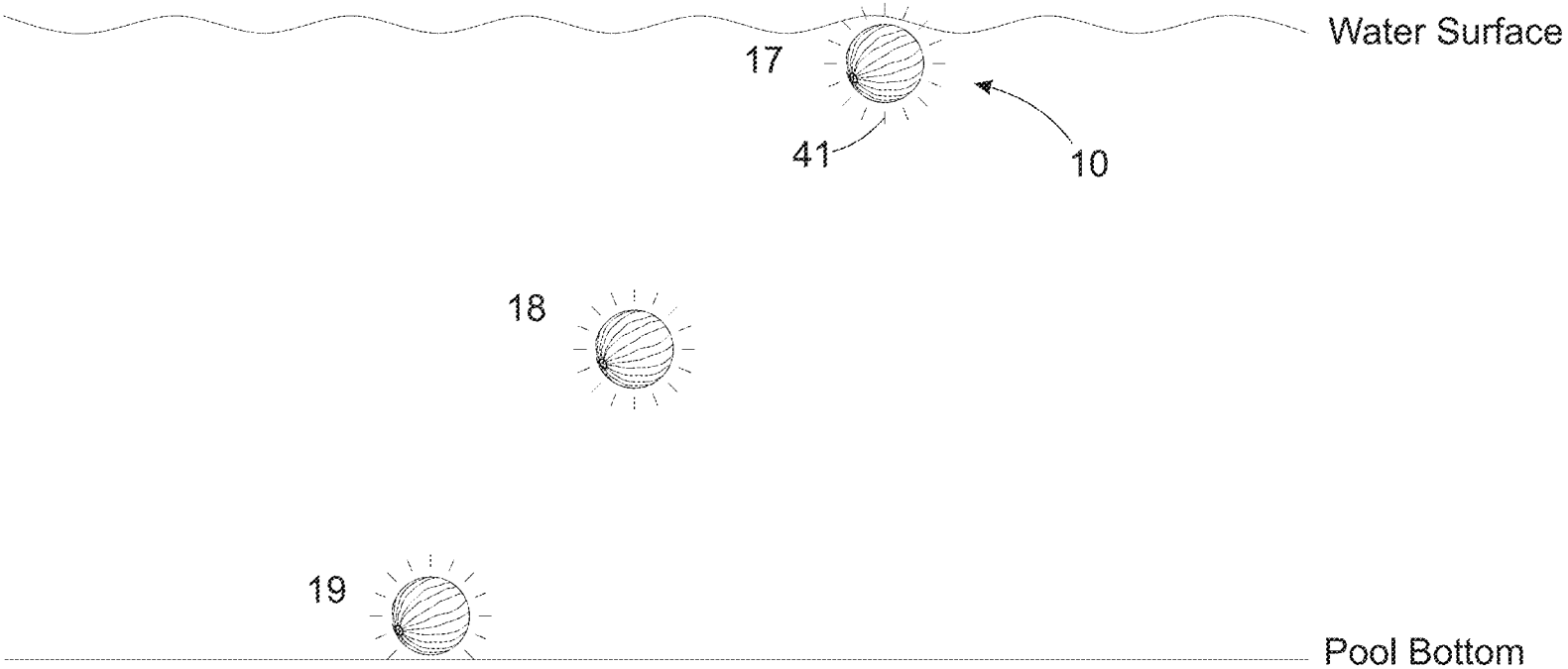
FIG. 10 is a side view of illuminated balls with different buoyancies.
Figure 11:
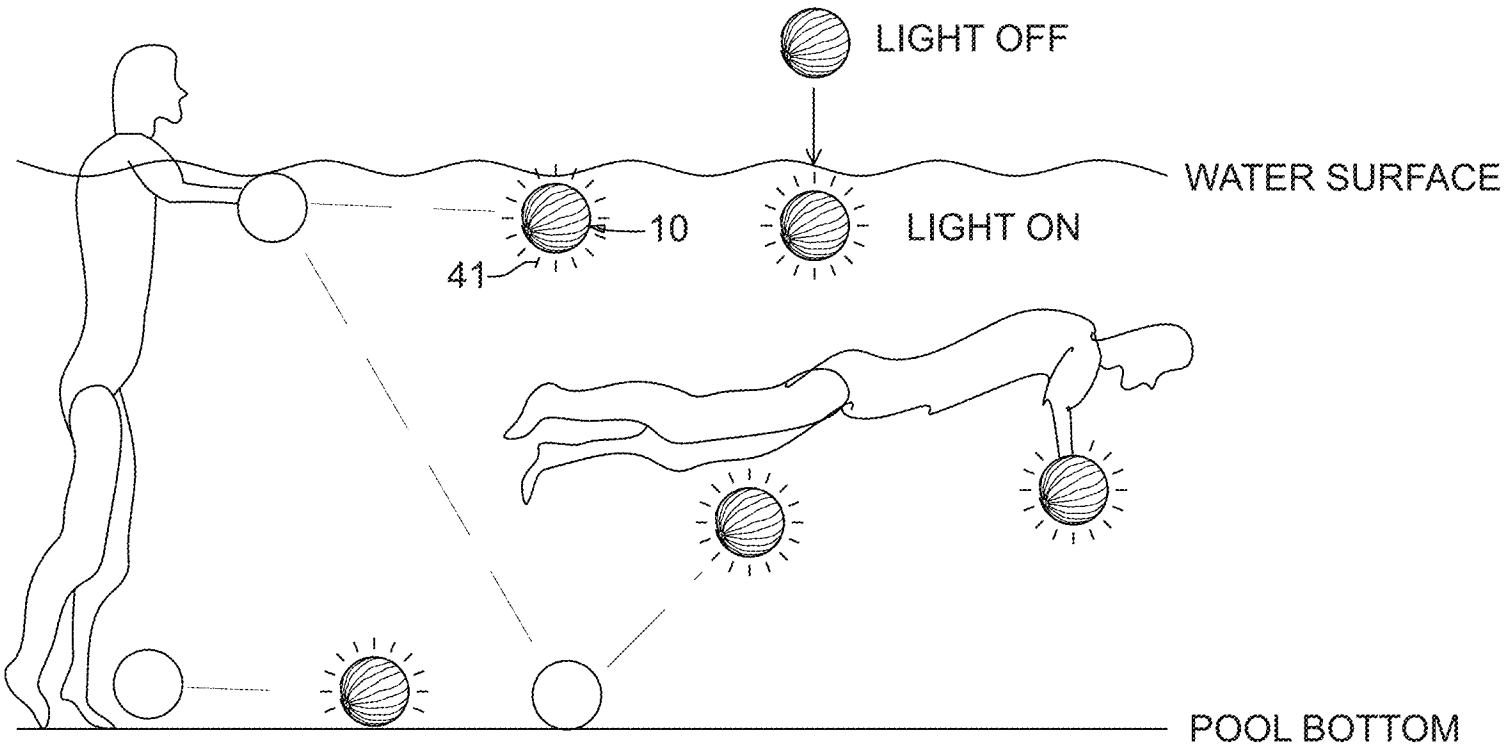
FIG. 11 is a side view of an illuminated ball in use.

The underwater play ball 10 may be filled with both water 13 and air 14 with a filling device 16 that is inserted into the self closing valve 15 until the preferred size of the underwater play ball 10 is equal to the size of a soccer ball or the preferred size determined by the user of the underwater play ball 10 during ball play as illustrated in FIG. 4. The amount of water 13 and air 14 may be varied inside the hollow cavity 9 of the underwater play ball 10 to give the ball positive buoyancy 17, neutral buoyancy 18, or negative buoyancy 19 as preferred by the user of the underwater play ball 10 as illustrated in FIG. 10. The shell 11 is capable of holding the pressure of the water 13 and air 14 and external forces due to play without rupturing.

The water 13 contained within the hollow cavity 9 of the ball 10 may be substituted with another type of fluid, water fluid mixture or weight.

As illustrated in FIGS. 4-7, the light housing 20 is bonded to the shell 11 of the underwater play ball 10. The adhesion contour 23 may provide additional adhesion strength where the shell 11 is in contact with the light housing 20. The sealing element shelf 21 provides a flat surface for the sealing element 38 connected to the battery housing 30 to seat to. The screw threads 22 engage with the screw threads 36 on the battery housing 30 allowing the battery housing 30 to be mechanically fastened within the light housing 20. The light housing 20 provides a water tight compartment for the battery housing 30.

As illustrated in FIGS. 4,5,7 and 8, the batteries 35 are inserted into the battery housing 30 through the battery opening 34. The battery housing 30 provides secure containment of the batteries 35. The manual switch 44 that is connected to light emitting device 40 is activated. The battery housing with the connected light emitting device 40 and water triggered switch 50 is inserted into the light housing 20 engaging the screw threads 22 36 and rotated until the sealing element 38 is compressed against the sealing element shelves 21 and 39 to provide the primary water tight seal. The sealing element 32 that sits within the sealing element groove 33 compresses between the inner surface of the light housing 20 and outer surface of the battery housing 30 to provide a secondary water tight seal. A coin, screwdriver, or other rigid flat object may be inserted into the slot 31 to help rotate the battery housing 30 into place.

The water contacts 55 and 56 of the water triggered switch 50 provide a smooth surface at the end of the conductors 51 and 52. When the water contacts 55 and 56 are submerged in water an electrical communication is created through the conductors 51 and 52 to the circuit board 53. The battery contact 54 provides electrical communication to the circuit board 53 from the batteries 35. The conductors 57 and 58 provide electrical communication from the circuit board 53 to the light emitting device 40. The conductor guides 37 provide a channel for the conductors 57 and 58 to sit in without making contact with the batteries 35. The circuit board 53 is printed to provide the electrical communications as illustrated in FIG. 8.

The light emitting device 40 is comprised of the majority of electrical components. The circuit board 45 provides a surface to where the manual switch 44, light emitting diode 42, battery contact 43, resistors 46 48, capacitor 47, and mosfet 49 may attach.

The light emitting diode 42 provides the emitted light 41 to the make underwater play ball 10 luminous.

The manual switch 44 provides complete power disruption from the battery 35 and any current conducting components. Deactivating the manual switch 44 is performed to maintain battery 35 life during long term storage of the underwater play ball 10. The manual switch 44 is an optional feature, however, it may be desirable to include a manual switch 44 to maintain the life of the components of the underwater play ball 10.

The resistor 46 limits the current conducted by the light emitting diode 42.

The water triggered switch 50 controls the voltage developed across resistor 48 thereby, controlling the current conducted through mosfet 49.

The mosfet 49 is provided with internal gate electrostatic discharge protection, or may be provided with external electrostatic discharge protection.

The capacitor 47 provides a brief power source to the input of the mosfet 49 when the water contacts 55 56 are removed from water. This allows the mosfet 49 to continue conducting current through the light emitting diode 42 allowing the underwater play ball 10 to remain illuminated during brief moments the ball may be removed from the water during play.

The circuit board 45 is printed to provide the electrical communications as illustrated in FIG. 8.

The water triggered switch 50 controls the voltage developed across resistor 48 thereby, controlling the current conducted through mosfet 49. Mosfet 49 is a high transconductance device to assure full current conductance for all water conditions.

Figure 9:
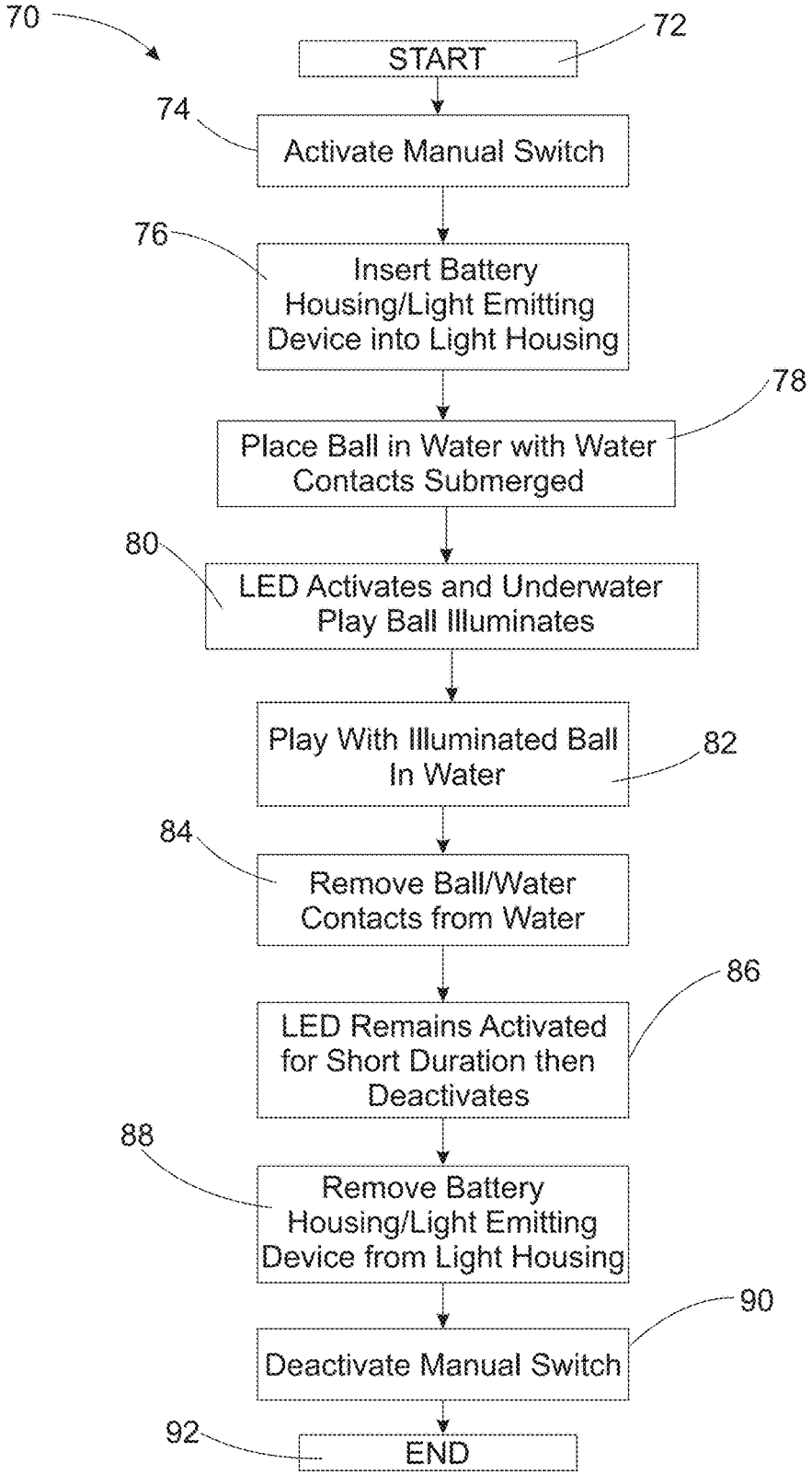
FIG. 9 is a flow chart illustrating a process of using an illuminated ball.

An overview of the operation of the illuminated play ball 70 is illustrated in FIG. 9. In order to start 72 operation of the illuminated play ball, the batteries are inserted into the battery housing. The manual switch connected to the light emitting device is activated 74. The battery housing with connected light emitting device and water triggered switch is inserted into the light housing 76. The underwater play ball is placed in water 78. The water activated switch activates the light emitting device making the underwater play ball luminous 80. The luminous underwater play ball is played with in the water 82. The luminous underwater play ball and associated water triggered switch is removed from the water 84. The light emitting device is deactivated after a short period of time 86. If the user desires long term storage of the underwater play ball, the battery housing is removed from the light housing 88 and the manual switch is deactivated 90. Use of the illuminated ball has ended 92 and the ball may be stored.

In alternate embodiments, the shell 11 of the underwater play ball 10 may be comprised of a material exhibiting fluorescence or phosphorescence properties. The shell 11 would emit visible light when exposed to ultraviolet light. The light emitting diode 42 may be of the type to emit ultraviolet light to allow the shell 11 to emit visible light when exposed to ultraviolet light. The shell 11 comprised of a material exhibiting phosphorescence properties would be capable of absorbing light energy when exposed to visible light or ultraviolet light sources and emitting visible light for a period after no exposure to the light sources.

In other embodiments, the water 13 contained in the hollow cavity 9 of the underwater play ball 10 may be mixed or substituted with a fluid exhibiting fluorescence or phosphorescence properties. The fluid would emit visible light when exposed to ultraviolet light. The light emitting diode 42 may be of the type to emit ultraviolet light to allow the fluid to emit visible light when exposed to the ultraviolet light. The fluid comprised of a material exhibiting phosphorescence properties would be capable of absorbing light energy when exposed to visible light or ultraviolet light sources and emitting visible light for a period after no exposure to the light sources.

Figure 12:
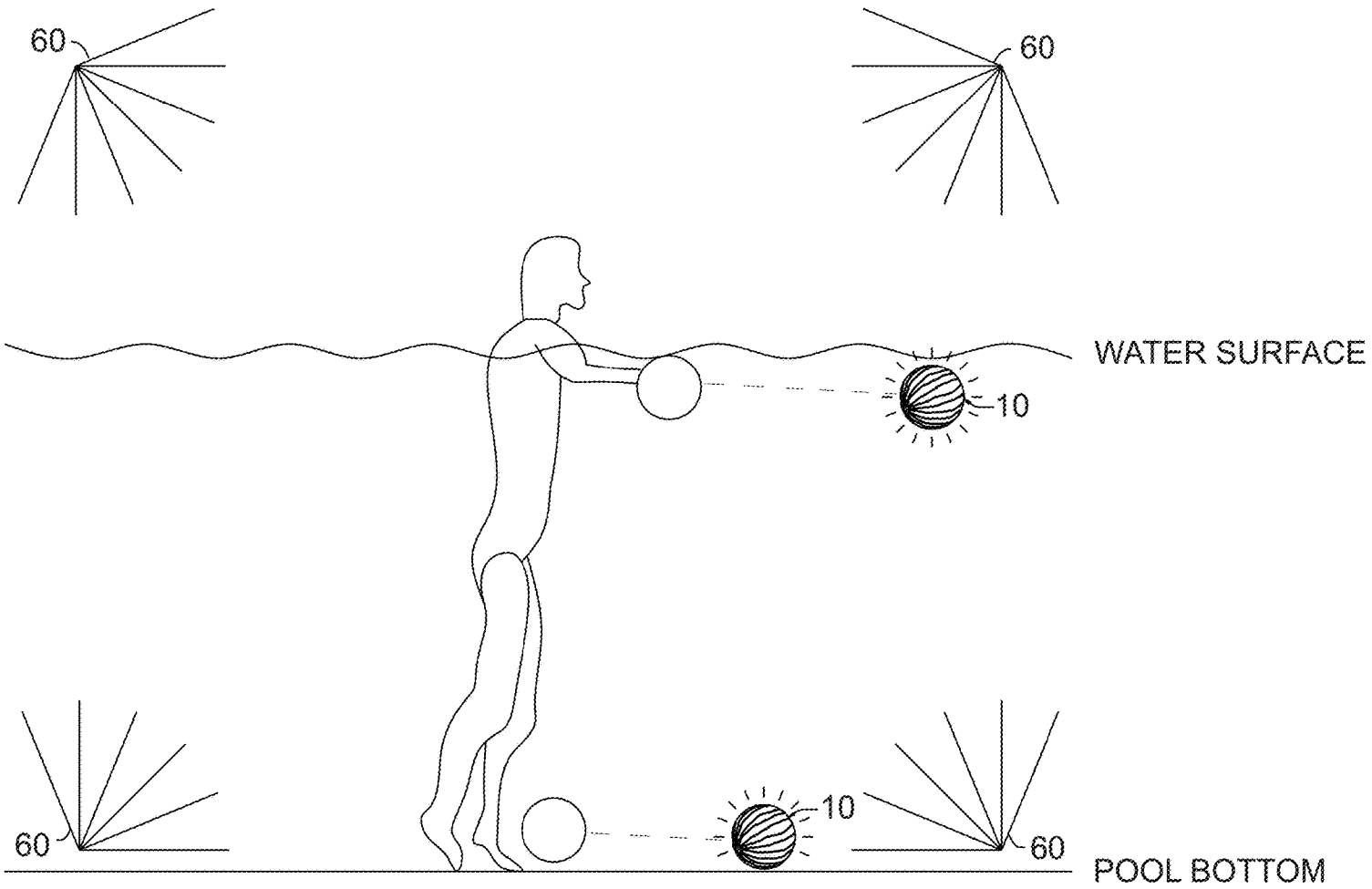
FIG. 12 is a view of an alternate embodiment of an illuminated ball in use.

In an additional embodiment illustrated FIG. 12, the light emitting device 40, water triggered switch 50, battery housing 30, light housing 20 may be eliminated from the underwater play ball 10. The underwater play ball 10 would be comprised of a fluorescent or phosphorescent shell 11 or fluorescent of phosphorescent fluid or both. An ultraviolet light emitter 60 may be external to the ball and be located above the water surface or below the water surface of a swimming pool or other body of water as illustrated in FIG. 12. The underwater play ball 10 would emit visible light when exposed to the ultraviolet light from the ultraviolet light emitter 60.

In further alternative embodiments, the water 13 contained in the hollow cavity 9 of the underwater play ball 10 may be mixed or substituted with a fluid exhibiting chemiluminescence properties.

Any of the stated alternative variations may be utilized separately or together.

Figure 3:
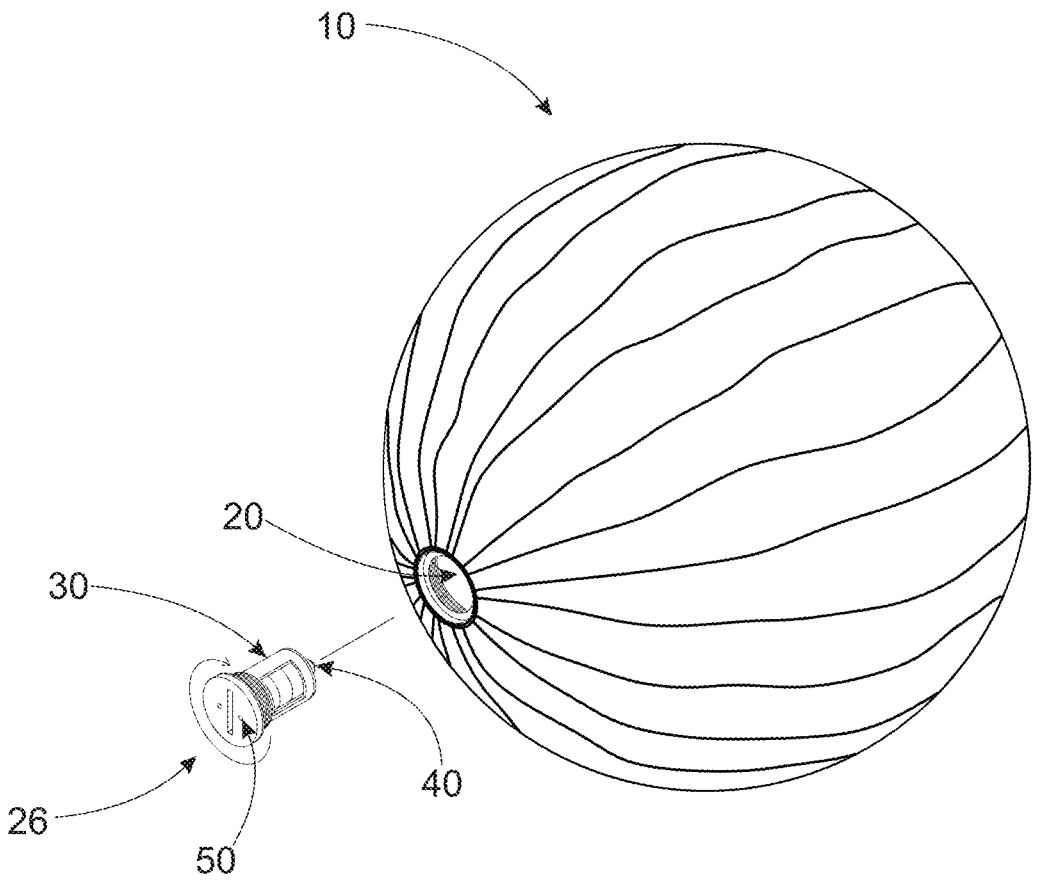
FIG. 3 is an exploded isometric view of an illuminated ball.

FIG. 3 shows a filling device 16 which may be used to fill a ball with both air and water. FIGS. 13-16 illustrate the filling device 16 in more detail.

A filling device 16 includes an adapter 102 onto which a tip 110 or inflation needle is coupled. The adapter 102 is illustrated as a hollow cylindrical member 100 with a smaller cylindrical member 106 coupled on top.

The main hollow cylindrical body 100 of the adapter is shaped and sized to screw on to the top of a hose or other water faucet. The hollow cylindrical member 100 has an open bottom with a closed or partially closed top. The open bottom fits over a hose when the filling device 16 is in use.

While illustrated as a hollow cylinder, the hollow cylindrical body 100 may have a square or rectangular outside with a cylindrical hollow on the interior.

Additionally, the hollow cylindrical body 100 may have indentations 104, ridges or other texture formed in its outer surface in order to allow users to grip the hollow cylindrical body 100 easier when coupling the filling device 16 to a hose or other faucet.

Figure 16:
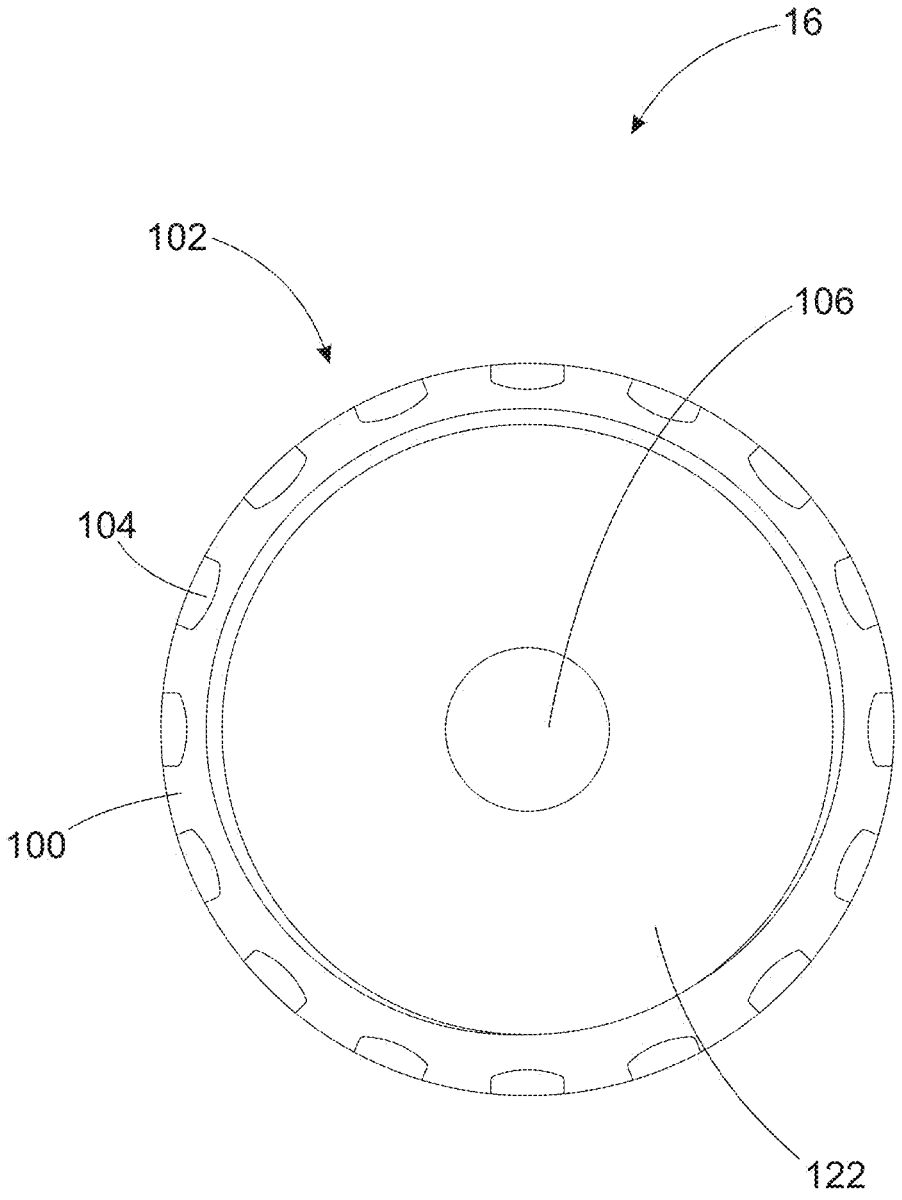
FIG. 16 is a bottom view of a filling device.

A smaller hollow cylindrical body or coupler 106 is coupled to the closed or partially closed top of the hollow cylindrical body 100. The coupler 106 is a smaller hollow cylindrical body that is hooked to the top of the hollow cylindrical body 100 over an opening in the closed top. As illustrated in FIG. 16, an opening through the top of the hollow cylindrical body 100 provides fluid communication with the coupler 106.

While illustrated as a hollow cylinder, the coupler 106 may be any shape or size desired, provided it allows an inflation needle to be coupled to the adapter 102.

Figure 13:
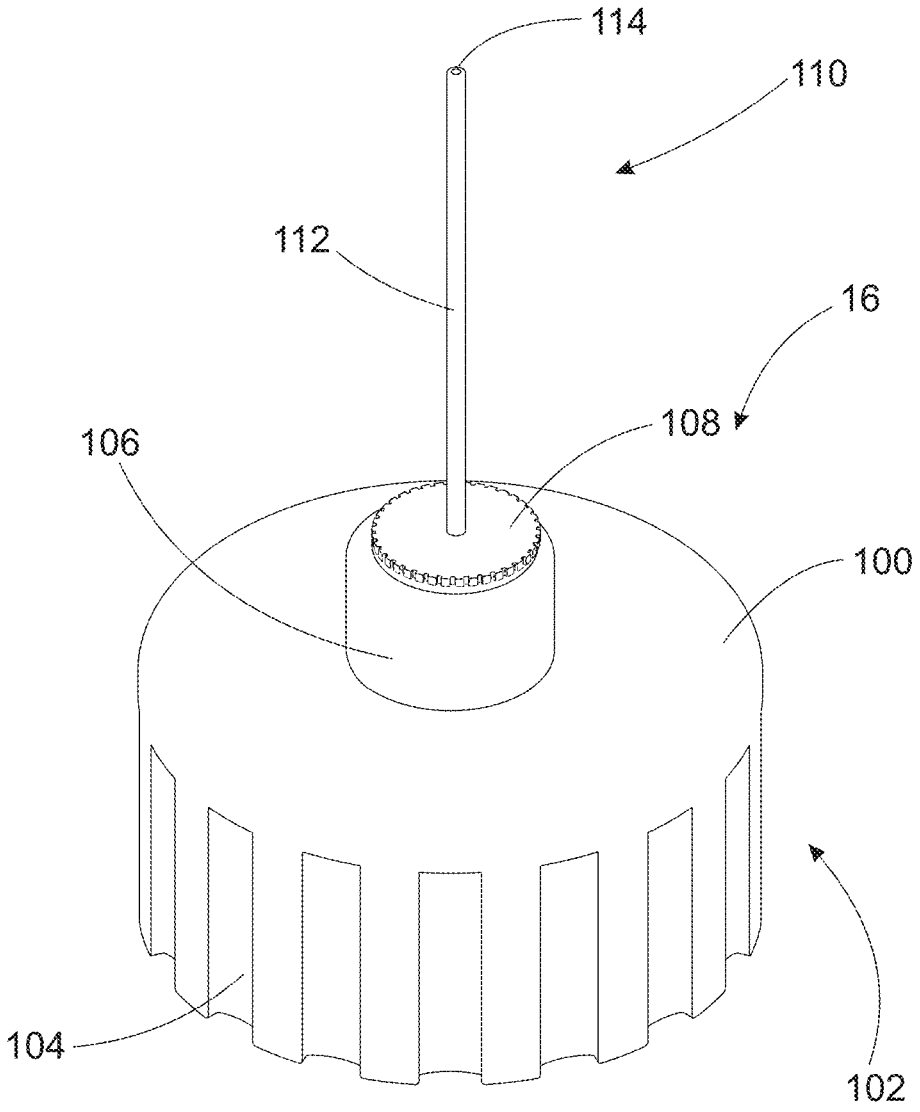
FIG. 13 is an isometric view of a filling device.
Figure 14:
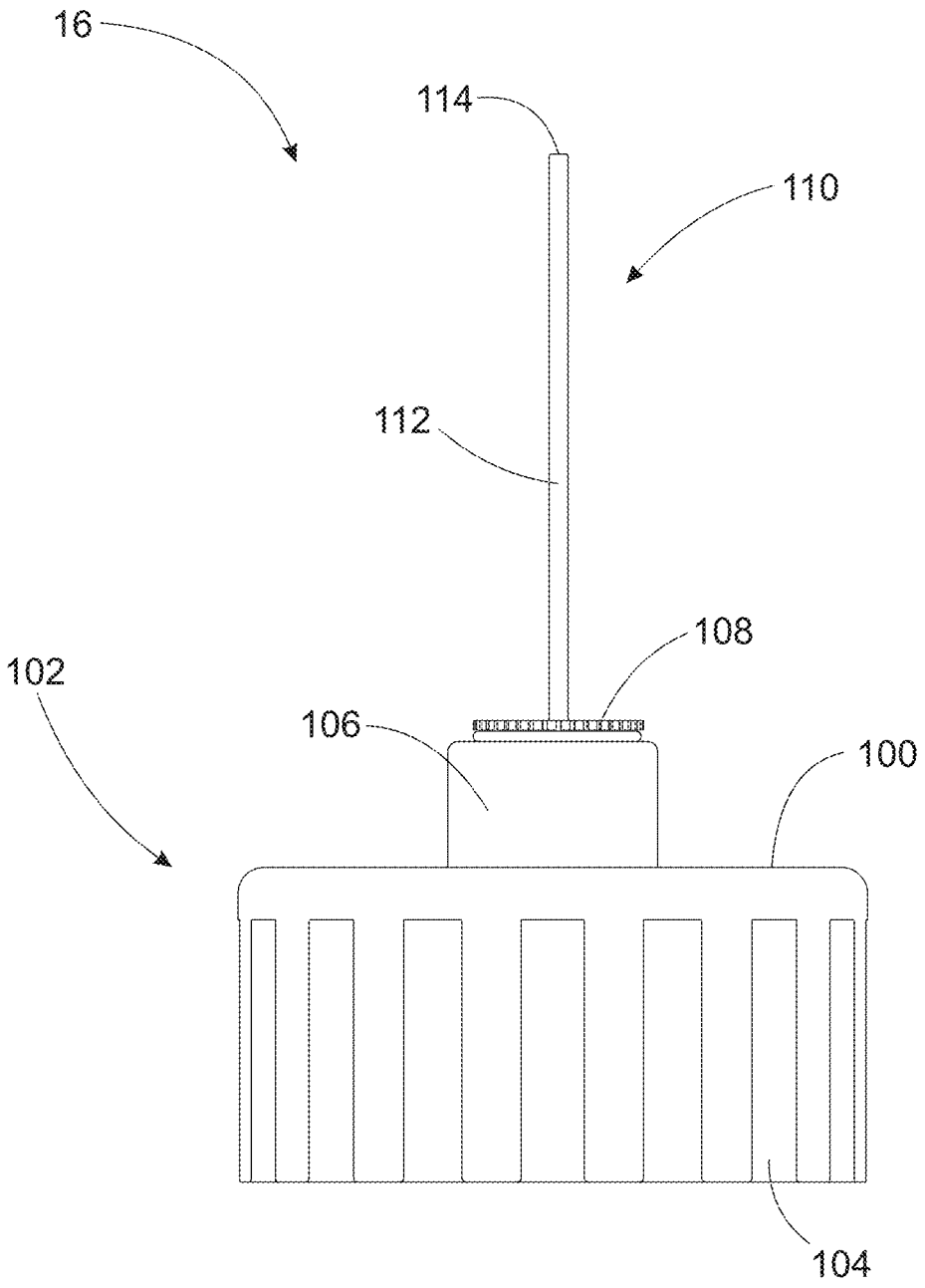
FIG. 14 is a front view of a filling device.

FIG. 13 also illustrates a tip or inflation needle 110 coupled to the coupler 106. The tip 110 has a larger portion 108 or coupling portion towards the bottom. The coupling portion 108 is a hollow cylindrical member with threads on its outside surface.

The tip 110 additionally includes a thin hollow needle-like cylinder 112 with an open bottom and an opening 114 located towards the top. This needle 112 is hollow in order to allow water to flow through the adapter and into a ball or other inflatable item. Water flows through the needle 112 just as air would if the needle 112 were coupled to an air pump.

The tip 110 in these figures is a standard ball inflation needle configured according to the prior art. The adapter 102 in these FIGS. allows a standard ball needle to be used to inflate a ball with water. Additionally, should the needle break, a replacement can be easily and cheaply found, rather than requiring the user to replace the entire filling device 16.

Figure 15:
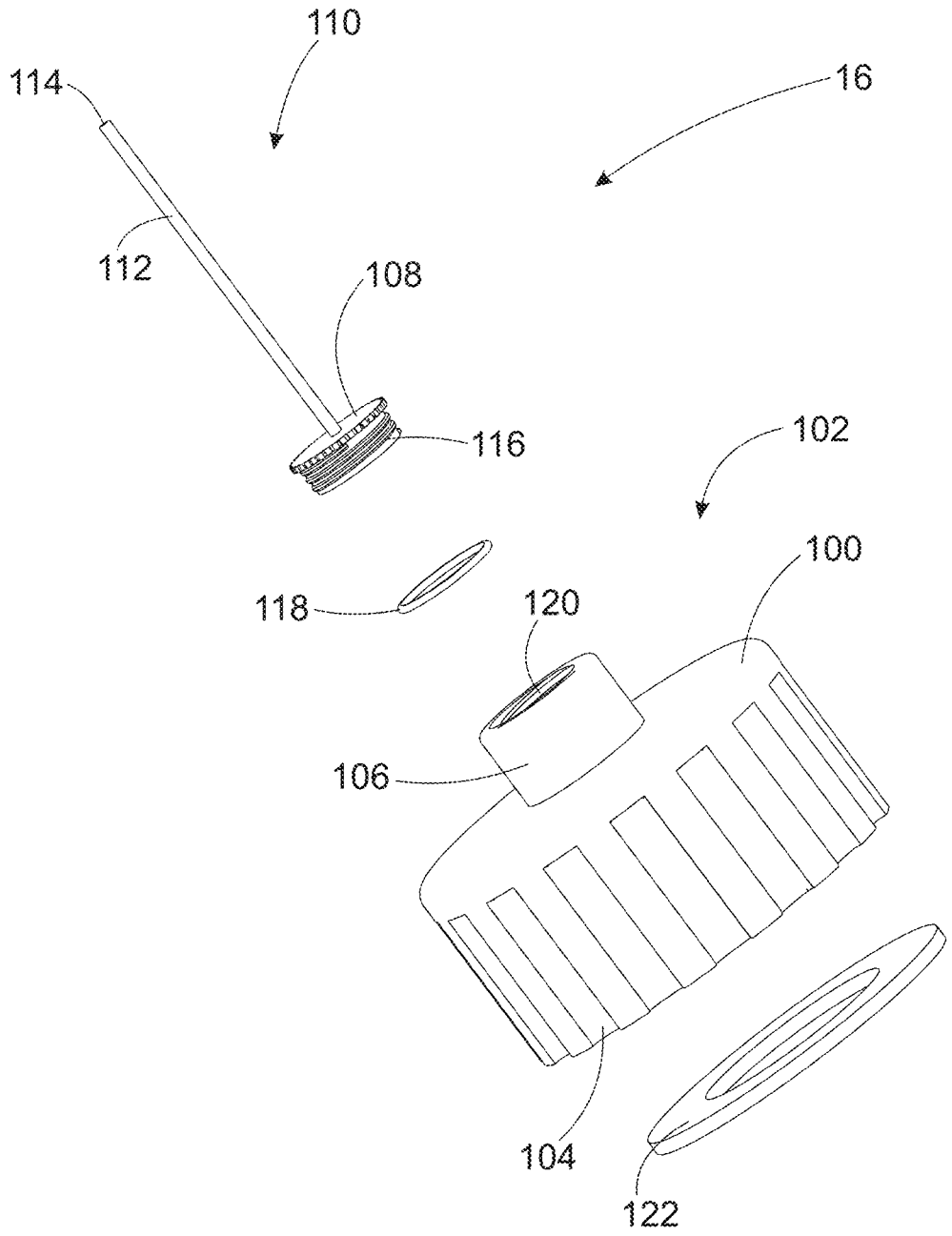
FIG. 15 is an exploded view of a filling device.

FIG. 15 illustrates an exploded view of the filling device 16. A washer 122 is placed within the cylindrical member 100. The washer 122 may be any washer that prevents water leakage, however, it is anticipated that this will be a simple rubber hose washer.

A smaller washer 118 is placed within the coupler 106 in order to prevent water leaking between the tip 110 and the coupler 106. This washer 118 may also be a simple rubber washer.

Additionally, FIG. 15 illustrates that the interior of the coupler 106 is threaded 120. The threads 120 in the coupler 106 allow a standard inflation needle or other tip 110 to be screwed into the adapter and coupled to a hose.

The threads 116 on the coupling portion of the needle or tip 110 mate with the threads 120 in the coupler 106.

FIG. 16 is a bottom view of a filling device 16. In FIG. 16, an opening in the closed top of the hollow cylindrical body 100 can be seen. The coupler 106 surrounds the opening. The opening allows water to travel from the hollow cylindrical body 100 through the coupler 106 and into the tip 110 and thereby into the inflatable item.

Figure 17:
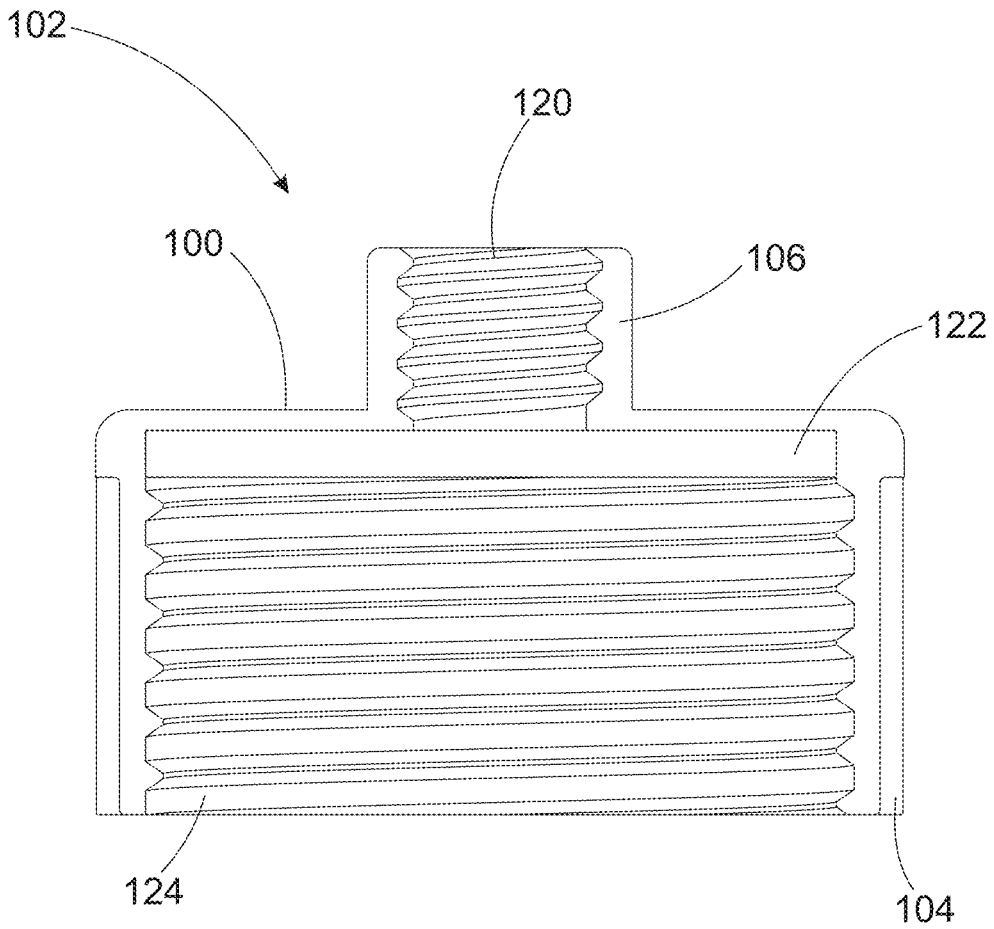
FIG. 17 is a cross-sectional view of a filling adapter taken along a center access.

FIG. 17 illustrates a cross sectional view of the interior of the adapter 102. As seen from FIG. 17, the interior of the hollow cylindrical body 100 and the interior of the coupler 106 are threaded.

The hollow cylindrical body 100 is threaded 124 so that it can be screwed onto the end of a hose, faucet or the like.

The coupler 106 has a threaded interior 120 in order to allow a standard ball inflation needle to be coupled to the adapter 102. The threads 120 also allow tips or needles to be removably coupled to the coupler 106. Therefore, if the inflation needle breaks or if a different tip is desired, the tip may be unscrewed from the coupler 106 and a new tip screwed into the coupler 106 as often as desired.

Figure 18:
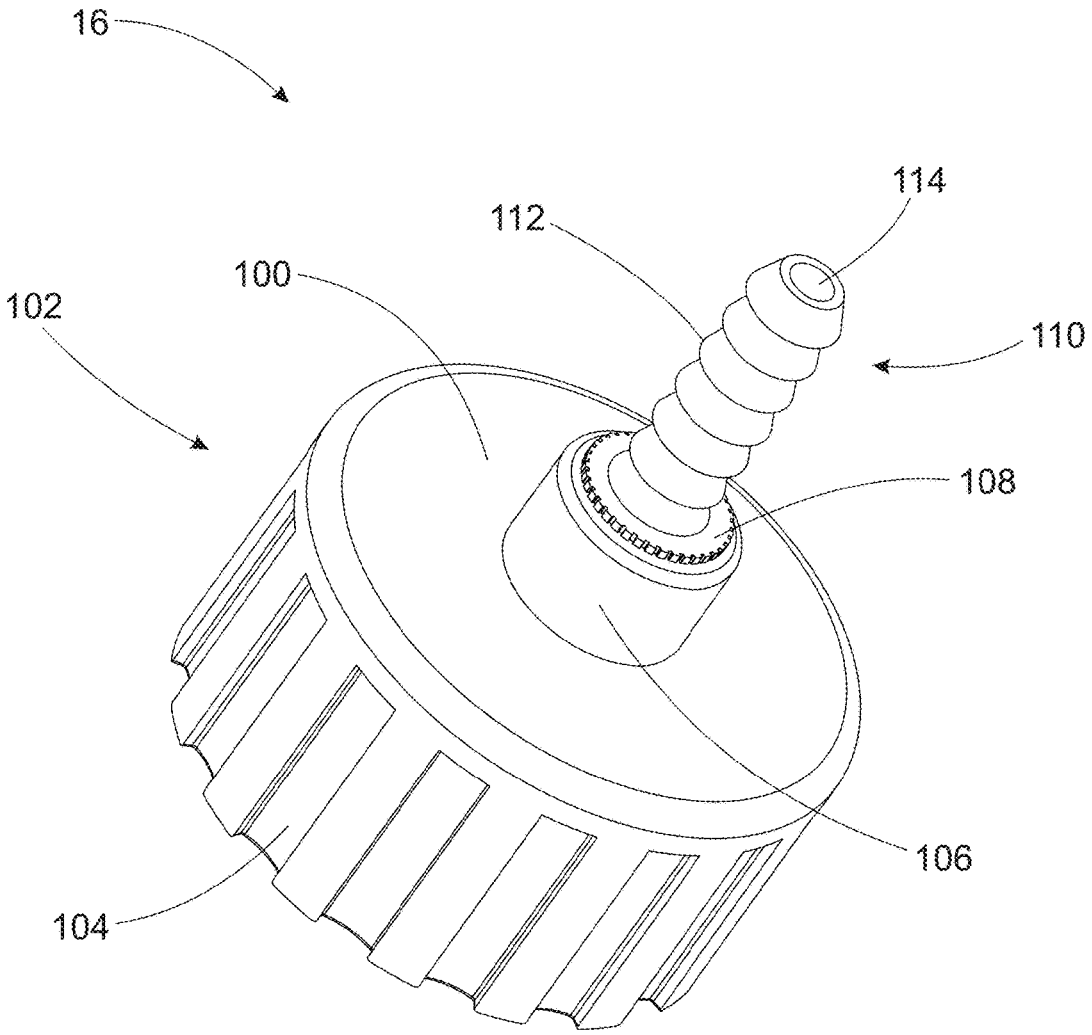
FIG. 18 is an isometric view of a filling device with a water balloon tip.

FIG. 18 illustrates a filling device 16 with an alternate tip 110 for use with the adapter 102. The tip 110 in this figure is for use in filling water balloons. The tip 110 has a cylindrical coupling portion 108 similar to the coupling portion 108 on the ball inflation needle. The needle 112 portion of the water balloon tip 110 is cylindrical in shape with ridges along the outside which help to prevent the water balloon from sliding off of the tip 110. An opening 114 near the top of the tip 110 allows water to flow through the tip 110 and fill the inflatable item.

Figure 19:
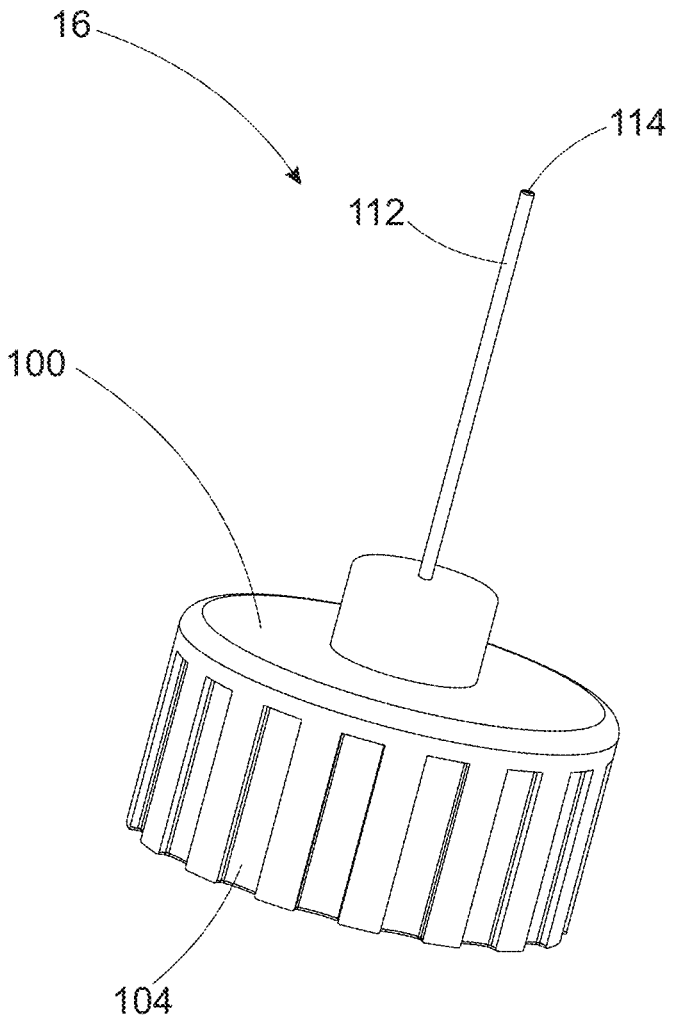
FIG. 19 is an isometric view of an alternate embodiment of a filling device.

FIG. 19 is an alternate embodiment of a filling device 108. In this embodiment, the adapter and the tip are formed as one piece. The hollow cylindrical portion 100 is similar to those discussed previously. The hollow cylindrical portion 100 has ridges 104 along the outer surface of the cylindrical portion 100 which help a user to better grip the filling device 108 when attaching it to a hose or other faucet. The tip includes a needle 112 with an opening 114 formed near the top of the needle 112.

In order to use the filling device 16, a tip 110 is screwed into or otherwise coupled onto an adapter 102. The tip 110 may be a standard ball filling needle or it may be a water balloon tip or the like. The adapter 102 is then screwed onto a water source such as a hose or faucet. The tip 110 is inserted into the ball or other inflatable item. The water is then turned on in the hose or faucet and water flows into the ball or other inflatable item.

When the user is done filling the inflatable item, the user turns the water off in the hose or faucet. The tip 110 is then removed from the inflatable item. The user may also uncouple or unscrew the tip 110 from the adapter 102 by rotating the coupling portion 108 of the tip 110 in the coupler 106 of the adapter 102.

A different tip 110 may now be attached to the adapter 102.

Accordingly, for the exemplary purposes of this disclosure, the components defining any embodiment of the invention may be formed as one piece if it is possible for the components to still serve their function. The components may also be composed of any of many different types of materials or combinations thereof that can readily be formed into shaped objects provided that the components selected are consistent with the intended mechanical operation of the invention. For example, the components may be formed of rubbers synthetic and/or natural, glasses, composites such as fiberglass, carbon-fiber and/or other like materials, polymers such as plastic, polycarbonate, PVC plastic, ABS plastic, polystyrene, polypropylene, acrylic, nylon, phenolic, any combination thereof, and/or other like materials, metals, such as zinc, magnesium, titanium, copper, iron, steel, stainless steel, any combination thereof, and/or other like materials, alloys, such as aluminum, and/or other like materials, any other suitable material, and/or any combination thereof.

The embodiments and examples set forth herein were presented in order to best explain the present invention and its practical applications and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. Accordingly, any components of the present invention indicated in the drawings or herein are given as an example of possible components and not as a limitation.

The invention claimed is:

1. A filling adapter comprising:

a first hollow cylindrical body having an open end and a partially open end;

threads formed in the interior of said first hollow cylindrical body, and at least one flexible washer contained in said first hollow cylindrical body;

a second hollow cylindrical body coupled to an opening in said partially open end of said first hollow cylindrical body;

a filling tip having a coupling portion having a lip, and at least one flexible washer coupled around the coupling portion; and a coupler coupled to said second hollow cylindrical body, wherein said coupler is configured to removably couple said coupling portion of said filling tip to said filling adapter, wherein coupling the coupling portion of said filling tip to said coupler compresses the at least one flexible washer coupled around the coupling portion between the lip of said coupling portion and the coupler, and wherein the at least one flexible washer contained in said first hollow cylindrical body and said at least one flexible washer coupled around the coupling portion of the filling tip seal the filling adapter from leaking liquid when the filling adapter is in use.

2. The filling adapter of claim 1, further comprising indentations formed on an outside surface of said first hollow cylindrical body.

3. The filling adapter of claim 1, wherein said coupler comprises threads on an interior of said second hollow cylindrical body.

4. The filling adapter of claim 1, wherein said filling tip is a ball filling needle.

5. The filling adapter of claim 1, further comprising a plurality of additional filling tips for filling a plurality of different items.

* * * * *